United States Patent [19]

Yu et al.

[11] Patent Number: 5,055,366

[45] Date of Patent: Oct. 8, 1991

[54] POLYMERIC PROTECTIVE OVERCOATINGS CONTAIN HOLE TRANSPORT MATERIAL FOR ELECTROPHOTOGRAPHIC IMAGING MEMBERS

[75] Inventors: Robert C. U. Yu, Webster; Ronald P. Premo, Rochester, both of N.Y.

[73] Assignee: Xerox Corporation, Stamford, Conn.

[21] Appl. No.: 457,857

[22] Filed: Dec. 27, 1989

[51] Int. Cl.[5] ..... G03G 5/14

[52] U.S. Cl. ..... 430/58; 430/66; 430/67; 430/59

[58] Field of Search ..... 430/66, 67, 58, 59

[56] References Cited

U.S. PATENT DOCUMENTS

| | | | |
|---|---|---|---|
| 3,121,006 | 2/1964 | Middleton et al. . | |
| 3,357,989 | 12/1967 | Byrne et al. . | |
| 3,442,781 | 5/1969 | Weinberger . | |
| 3,879,199 | 4/1975 | Trubisky . | |
| 3,954,464 | 5/1976 | Karam et al. | 430/67 |
| 4,076,405 | 2/1978 | Silverberg . | |
| 4,260,671 | 4/1981 | Merrill . | |
| 4,265,990 | 5/1981 | Stolka et al. . | |
| 4,286,033 | 8/1981 | Neyhart et al. . | |
| 4,291,110 | 9/1981 | Lee . | |
| 4,338,387 | 7/1982 | Hewitt . | |
| 4,368,669 | 1/1983 | Love, III . | |
| 4,390,609 | 6/1983 | Wiedemann . | |
| 4,415,639 | 11/1983 | Horgan . | |
| 4,423,131 | 12/1983 | Limburg et al. . | |
| 4,489,148 | 12/1984 | Horgan et al. . | |
| 4,515,882 | 5/1985 | Mammino et al. . | |
| 4,521,457 | 6/1985 | Russell et al. . | |
| 4,562,132 | 12/1985 | Ong et al. . | |
| 4,664,995 | 5/1987 | Horgan et al. . | |
| 4,772,526 | 9/1988 | Kan et al. . | |
| 4,784,928 | 11/1988 | Kan et al. . | |
| 4,786,570 | 11/1988 | Yu et al. . | |
| 4,835,081 | 5/1989 | Ong et al. | 430/58 X |
| 4,851,316 | 7/1989 | Lu et al. | 430/115 |

*Primary Examiner*—David Welsh

*Attorney, Agent, or Firm*—Oliff & Berridge

[57] ABSTRACT

A protective overcoating layer for an electrophotographic imaging device prevents crystallization and leaching of charge transport compounds in a charge transport layer of the device, while also preventing solvent and ink contact/bending stress charge transport layer cracking. The overcoating layer contains a film forming binder material or polymer blend doped with a charge transport compound in an amount less than about 10% by weight. The overcoating layer may alternatively contain a single component hole transporting carbazole polymer or polymer blend of hole transport carbazole polymer with a film forming polymer.

17 Claims, 1 Drawing Sheet

POLYMERIC PROTECTIVE OVERCOATINGS CONTAIN HOLE TRANSPORT MATERIAL FOR ELECTROPHOTOGRAPHIC IMAGING MEMBERS

BACKGROUND OF THE INVENTION

This invention relates to electrophotography, and more particularly, to an improved overcoating layer for an electrophotographic imaging member.

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as paper. This imaging process may be repeated many times with reusable photoconductive insulating layers.

An electrophotographic imaging member may be provided in a number of forms. For example, the imaging member may be a homogeneous layer of a single material such as vitreous selenium or it may be a composite layer containing a photoconductor and another material. One type of composite imaging member comprises a layer of finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of photo-generating holes and injecting the photogenerated holes into the charge transport layer.

Other composite imaging members have been developed having numerous layers which are highly flexible and exhibit predictable electrical characteristics within narrow operating limits to provide excellent images over many thousands of cycles. One type of multilayered photoreceptor that has been employed as a belt in electrophotographic imaging systems comprises a substrate, a conductive layer, a hole blocking layer, an adhesive layer, a charge generating layer, and a charge transport layer. This photoreceptor may also comprise additional layers such as an anti-curl back coating and an overcoating layer.

Imaging members are generally exposed to repetitive electrophotographic cycling which subjects exposed layers of imaging devices to abrasion, chemical attack, heat and multiple exposure to light. This repetitive cycling leads to a gradual deterioration in the mechanical and electrical characteristics of the exposed layers. For example, repetitive cycling has adverse effects on exposed portions of the imaging member. Attempts have been made to overcome these problems. However, the solution of one problem often leads to additional problems.

In electrophotographic imaging devices, the charge transport layer may comprise a high loading of a charge transport compound dispersed in an appropriate binder. The charge transport compound may be present in an amount greater than about 35% based on weight of the binder. For example, the charge transport layer may comprise 50% of a charge transport compound in about 50% binder. A high loading of charge transport compound appears to drive the chemical potential of the charge transport layer to a point near the metastable state, which is a condition that induces crystallization, leaching and stress cracking when placed in contact with a chemically interactive solvent or ink. Photoreceptor functionality may be completely destroyed when a charge transport layer having a high loading of a charge transport molecule is contacted with liquid ink. It is thus desirable to eliminate charge transport molecule crystallization, leaching and solvent-stress charge transport layer cracking.

Another problem in multilayered belt imaging systems includes cracking in one or more critical imaging layers during belt cycling over small diameter rollers. Cracks developed in the charge transport layer during cycling are a frequent phenomenon and most problematic because they can manifest themselves as print-out defects which adversely affect copy quality. Charge transport layer cracking has a serious impact on the versatility of a photoreceptor and reduces its practical value for automatic electrophotographic copiers, duplicators and printers.

Another problem encountered with electrophotographic imaging members is corona species induced deletion in print due to degradation of the charge transport molecules by chemical reaction with corona species. During electrophotographic charging, corona species are generated. Corona species include, for example ozone, nitrogen oxides, acids and the like.

A number of overcoating layers have been proposed for various purposes. U.S. Pat. No. 4,784,928 to Kan et al. discloses a reusable electrophotographic element comprising first and second charge transport layers. The second charge transport layer has irregularly shaped fluorotelomer particles, an electrically nonconductive substance, dispersed in a binder resin. The second charge transport layer allows for toner to be uniformly transferred to a contiguous receiver element with minimal image defects.

U.S. Pat. No. 4,260,671 to Merrill discloses various polycarbonate overcoats which provide an increased resistance to solvents and abrasions.

U.S. Pat. No. 4,390,609 to Wiedemann discloses a protective transparent cover layer made of an abrasion-resistant binder composed of polyurethane resin and a hydroxyl group containing polyester or polyether, and a polyisocyanate.

There continues to be a need for improved overcoatings for electrophotographic imaging members, which overcoatings will provide better protection for the charge transport layer from adverse mechanical- and chemical-induced effects.

SUMMARY OF THE INVENTION

It is an object of the invention to provide a protective overcoating layer for an electrophotographic imaging member.

It is an object of the invention to prevent cyrstallization of charge transport molecules in a charge transport layer of an electrophotographic imaging member.

It is also an object of the invention to prevent surface migration of charge transport molecules in the charge transport layer.

It is yet another object of the invention to provide an improved electrophotographic imaging member with improved charge transport layer resistance to solvent or chemical exposure and tensile stress cracking.

It is a further object of the invention to provide an improved overcoating that extends the dynamic fatique cracking life of the charge transport layer over small diameter rollers during belt cycling machine function.

The present invention overcomes the shortcomings of the prior art by providing a protective overcoating layer for a charge transport layer which prevents crystallization and leaching of charge transport molecules in the charge transport layer while also effectively preventing stress cracking of the charge transport layer upon exposure to solvent or chemical vapor. The overcoating layers of the present invention comprise a film forming polymer binder doped with a charge transport molecules. Alternatively, polymer blends having inherent charge transporting capabilities in a polymer overcoat may be used. An overcoating layer comprising a polymer film forming binder doped with 10 weight percent or less of the charge transport molecules can effectively prevent crystallization and leaching of charge transport materials in the charge transport layer, while also effectively preventing it from solvent exposure and chemical contact stress cracking. A range of about 3 to about 7 weight percent of charge transport molecule doping in the overcoating layer is preferred.

BRIEF DESCRIPTION OF THE DRAWING

A more complete understanding of the invention can be obtained by reference to the accompanying Figure which is a cross-sectional view of an electrophotographic imaging member of the invention.

DETAILED DESCRIPTION OF PREFERRED EMBODIMENTS

Figure 1:
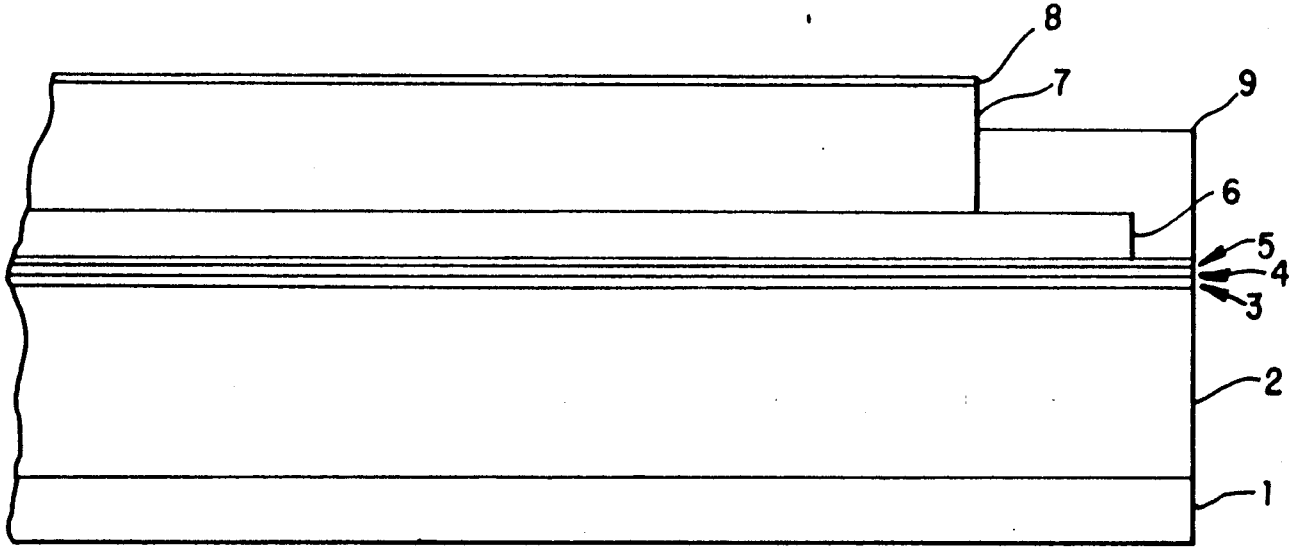

The protective overcoating of the present invention may be applied to a charge transport layer of an electrophotographic imaging member having any of a number of configurations. For example, an electrophotographic imaging member may comprise at least one imaging layer capable of retaining an electrostatic latent image, and a supporting substrate layer having an electrically conductive surface. At least one imaging layer may comprise a charge transport layer and a charge generating layer. The imaging device may further comprise additional layers such as a blocking layer, an adhesive layer, and an anti-curl layer.

A representative structure of an electrophotographic imaging member is shown in FIG. 1. This imaging member is provided with an anti-curl layer 1, a supporting substrate 2, an electrically conductive ground plane layer 3, a hole blocking layer 4, an adhesive layer 5, a charge generating layer 6, and a charge transport layer 7. An overcoating layer 8 is also shown in the Figure.

In the above described device, a ground strip 9 may be provided adjacent the charge transport layer at an outer edge of the imaging member. See U.S. Pat. No. 4,664,995. The ground strip 9 is coated adjacent to the charge transport layer so as to provide grounding contact with a grounding device, (not shown) during electrophotographic processes.

A description of the layers of the electrophotographic imaging member shown in the Figure follows.

The Supporting Substrate

The supporting substrate 2 may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E. I. du Pont de Nemours & Co., or Melinex available from ICI Americas Inc. Alternatively, the substrate may be a rigid drum.

The thickness of the substrate layer depends on numerous factors, including mechanical performance and economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example less than 50 micrometers, provided there are no adverse effects on the final photoconductive device.

The Electrically Conductive Ground Plane Layer

The electrically conductive ground plane layer 3 may be an electrically conductive metal layer which may be formed, for example, on the substrate 2 by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be between about 20 Angstroms to about 750 Angstroms, and more preferably from about 50 Angstroms to about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The Charge Blocking Layer

After deposition of the electrically conductive ground plane layer, the charge blocking layer 4 may be applied thereto. Charge blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryrol, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110. A preferred hole blocking layer comprises a reaction product between a hydrolyzed silane or mixtures of hydrolyzed silanes and the oxidized surface of a metal ground plane layer. The oxidized surface inherently forms on the outer surface of most metal ground plane layers when exposed to air after deposition. This combination enhances electrical stability at low RH. Hydrolyzed silanes have the general formula

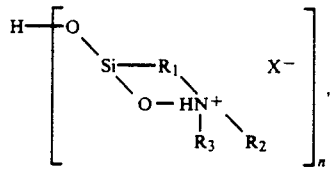

I or

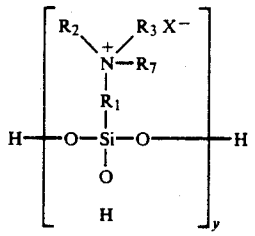

II wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 1–4. The imaging member is preferably prepared by depositing on the metal oxide layer of a metal conductive layer, a coating of an aqueous solution of the hydrolyzed aminosilane at a pH between about 4 and about 10, drying the reaction product layer to form a siloxane film and applying an adhesive layer, and thereafter applying electrically operative layers, such as a photogenerator layer and a hole transport layer, to the adhesive layer.

The hole blocking layer should be continuous and have a thickness of less than about 0.5 micrometer because greater thicknesses may lead to undesirably high residual voltage. A hole blocking layer of between about 0.005 micrometer and about 0.3 micrometer is preferred because charge neutralization after the exposure step is facilitated and optimum electrical performance is achieved. A thickness of between about 0.03 micrometer and about 0.06 micrometer is preferred for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Adhesive Layer

In most cases, intermediate layers between the injection blocking layer and the adjacent charge generating or photogenerating layer may be desired to promote adhesion. For example, the adhesive layer 5 may be employed. If such layers are utilized, they preferably have a dry thickness between about 0.001 micrometer to about 0.2 micrometer. Typical adhesive layers include film-forming polymers such as copolyester, du Pont 49,000 resin (available from E. I. du Pont de Nemours & Co.), vitel-PE100 (available from Goodyear Rubber & Tire Co.), polyvinylbutyral, polyvinylpyrolidone, polyurethane, polymethyl methacrylate, and the like.

The Charge Generating Layer

Any suitable charge generating (photogenerating) layer 6 may be applied to the adhesive layer 5. Examples of photogenerating layers include inorganic photoconductive particles such as amorphous selenium, trigonal selenium, and selenium alloys selected from the group consisting of selenium-tellurium, selenium-tellurium-arsenic, selenium arsenide and phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from du Pont under the tradename Monastral Red, Monastral Violet and Monastral Red Y, Vat orange 1 and Vat orange 3 (trade names for dibromo anthanthrone pigments), benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like, dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639. Other suitable photogenerating materials known in the art may also be utilized, if desired. Charge generating layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Any suitable polymeric film forming binder material may be employed as the matrix in the photogenerating binder layer. Typical polymeric film forming materials include those described, for example, in U.S. Pat. No. 3,121,006.

The photogenerating composition or pigment is present in the resinous binder composition in various amounts, generally from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer generally ranges in thickness from about 0.1 micrometer to about 5.0 micrometers, preferably from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved. Any suitable and conventional technique may be utilized to mix and thereafter apply the photogenerating layer coating mixture to the previously dried adhesive layer. Typical application techniques include spraying, dip coating, roll coating, wire wound rod coating, and the like. Drying of the deposited coating may be effected by any suitable conventional technique such as oven drying, infrared radiation drying, air drying, vacuum drying, and the like, to remove substantially all of the solvents utilized in applying the coating.

The Active Charge Transport Layer

The active charge transport layer 7 may comprise any suitable transparent organic polymer or non-polymeric material capable of supporting the injection of photo-generated holes and electrons from the charge generating layer 6 and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 9000 Angstroms. The charge transport layer is substantially transparent to radiation in a region in which the photoconductor is to be used. It is comprised of a material which supports the injection of photogenerated holes from the charge generating layer. The active charge transport layer is normally transparent when exposure is effected therethrough to ensure that most of the incident radiation is utilized by the underlying charge generating layer. When used with a transparent substrate, imagewise exposure or erase may be accomplished through the substrate with all light passing through the substrate. In this case, the active charge transport material need not transmit light in the wavelength region of use. The charge transport layer in conjunction with the charge generating layer is an insulator to the extent that an electrostatic charge placed on the charge transport layer is not conducted in the absence of illumination.

The active charge transport layer may comprise activating compounds dispersed in normally electrically inactive polymeric materials making these materials electrically active. These compounds may be added to polymeric materials which are incapable of supporting the injection of photogenerated holes and incapable of allowing the transport of these holes. An especially preferred transport layer employed in multilayer photoconductors comprises from about 25 percent to about 75 percent by weight of at least one charge transporting aromatic amine compound, and about 75 percent to about 25 percent by weight of a polymeric film forming resin in which the aromatic amine is soluble.

The charge transport layer is preferably formed from a mixture comprising an aromatic amine compound of one or more compounds having the general formula:

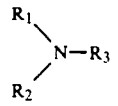

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl groups having from 1 to 18 carbon atoms and cycloaliphatic compounds having from 3 to 18 carbon atoms. The substituents should be free from electron withdrawing groups such as $NO_2$ groups, CN groups, and the like. Typical aromatic amine compounds that are represented by this structural formula include:

I. Triphenyl amines such as:

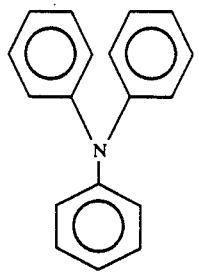

II. Bis and poly triarylamines such as:

-continued

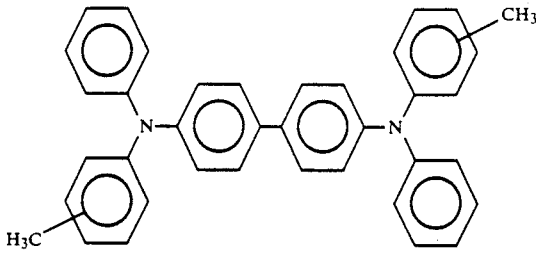

III. Bis arylamine ethers such as:

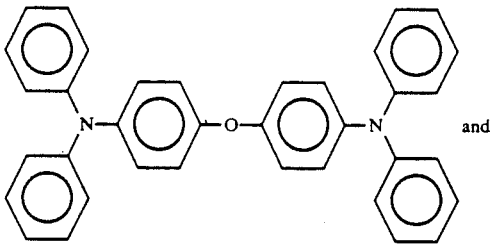

and

IV. Bis alkyl-arylamines such as:

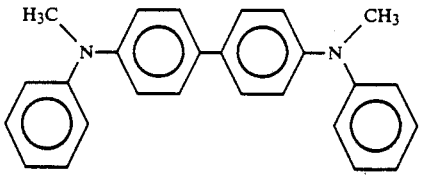

A preferred aromatic amine compound has the general formula:

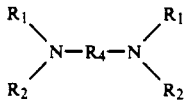

wherein $R_1$ and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free from electron withdrawing groups such as $NO_2$ groups, CN groups, and the like.

Examples of charge transporting aromatic amines represented by the structural formulae above include triphenylmethane, bis(4-diethylamine-2-methylphenyl)-phenylmethane; 4'-4''-bis(diethylamino)-2', 2''-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(3''-methylphenyl)-(1,1'-biphenyl)-4,4'-diamine, and the like, dispersed in an inactive resin binder.

Any suitable inactive resin binder in which the charge transport molecules are soluble or molecularly dispersed in methylene chloride or other suitable solvent may be employed. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; a polycarbonate resin having a molecular weight of from about 50,000 to about 100,000, available as Makrolon from Farben Fabricken Bayer A. G.; a polycarbonate resin having a molecular weight of from about 20,000 to about 50,000 available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

An especially preferred multilayered photoconductor comprises a charge generating layer comprising a binder layer of photoconductive material and a contiguous hole transport layer of a polycarbonate resin material having a molecular weight of from about 20,000 to about 120,000 having dispersed therein from about 25 to about 75 percent by weight of one or more compounds having the general formula:

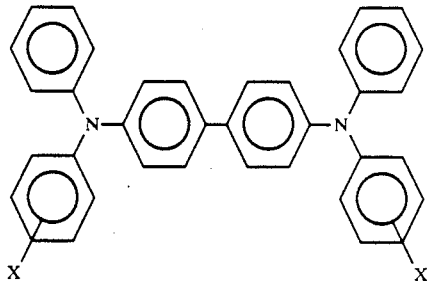

wherein X is selected from the group consisting of an alkyl group, having from 1 to about 4 carbon atoms and chlorine, photoconductive layer exhibiting the capability of photogeneration of holes and injection of the holes, the hole transport layer being substantially non-absorbing in the spectral region at which the photoconductive layer generates and injects photogenerated holes but being capable of supporting the injection of photogenerated holes from the photoconductive layer and transporting the holes through the hole transport layer.

The thickness of the charge transport layer may range between about 10 micrometers and about 50 micrometers, but preferably between about 20 micrometers and about 35 micrometers. A range from about 23 micrometers to about 31 micrometers is optimum.

The Ground Strip

The ground strip may comprise a film forming polymer binder and electrically conductive particles. Cellulose may be added to disperse the electrically conductive particles. Any suitable electrically conductive particles may be used in the electrically conductive ground strip layer 9 of this invention. The ground strip 9 may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The thickness of the ground strip layer is generally from about 7 micrometers to about 40 micrometers. A preferred thickness may range from about 13 micrometers to about 28 micrometers, and more preferably from about 16 micrometers to about 24 micrometers.

The Anti-Curl Layer

The anti-curl layer 1 may comprise organic polymers or inorganic polymers that are electrically insulating or slightly semi-conductive. The anti-curl layer provides flatness and/or abrasion resistance. Anticurl layer 1 may be formed at the back side of the substrate 2, opposite to the imaging layers. The anticurl layer may comprise a film forming resin and an adhesion promoter polyester additive. Examples of film forming resins include polyacrylate, polystyrene, poly(4,4'-isopropylidene diphenyl carbonate), 4,4'-cyclohexylidene diphenyl polycarbonate, and the like. Typical adhesion promoters used as additives include 49,000 (du Pont), Vitel PE-100, Vitel PE-200, Vitel-PE-307 (Goodyear), and the like. Usually from about 1 to about 5 weight percent adhesion promoter is selected for film forming resin addition. The thickness of the anticurl layer is from about 3 micrometers to about 35 micrometers, and preferably about 14 micrometers.

The Overcoating Layer

In an embodiment of the invention, a protective overcoating layer is provided over the charge transport layer. The protective overcoating layer of the present invention comprises a film forming binder doped with a charge transport compound.

Any suitable film forming inactive resin binder may be employed in the overcoating layer of the present invention. For example, the film forming binder may be any of a number of resins such as polycarbonates, polycarbazoles, polyarylates, polystyrene, polysulfone, polyphenylene sulfide, polyetherimide, and polyacrylate. The resin binder used in the overcoating layer may be the same or different from the resin binder used in the charge transport layer. The binder resins should have a Young's modulus greater than about $2\times10^5$ psi, a break elongation no less than 10 percent, and a glass transition temperature greater than 150° C. The binder may further be a blend of binders. The preferred polymeric film forming binders include Makrolon, a polycarbonate resin having a molecular weight of from about 50,000 to about 100,000 available from Farbenfabricken Bayer A. G., 4,4'cyclohexylidene diphenyl polycarbonate available from Mitsubishi Chemicals, high molecular weight Lexan 135 available from the General Electric Company, Ardel polyarylate D-100 available from Union Carbide, and polymer blends of Makrolon available from Farbenfabricken Bayer A. G. and copolyester Vitel-PE100 or Vitel-PE200, available from Goodyear Tire and Rubber Company. A range of about 1% by weight to about 10% by weight of Vitel copolyester is preferred in blended compositions, and more preferably about 3% by weight to about 7% by weight. To provide hole transporting capability through the overcoats, the above-mentioned binder resins or resin blends should be doped with at least 5% by weight charge transporting compound. Other polymers which can be used as resins in the overcoat include Durel polyarylate from Celanese, polycarbonate copolymers Lexan 3250, Lexan PPC 4501, and Lexan PPC 4701 from the General Electric Company and Calibre from Dow.

Polymeric materials which have inherent hole transporting properties such as carbazole polymers may be used as photoreceptor overcoats without the need for charge transport compound doping. These carbazoles can be used alone or in blends of film forming polymer binder and at least 30% by weight carbazole polymer. The carbazole polymers of interest are as follows:

(A)

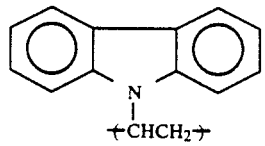

(B)

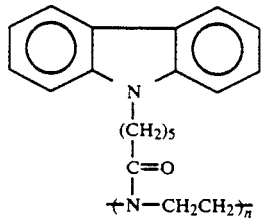

(C)

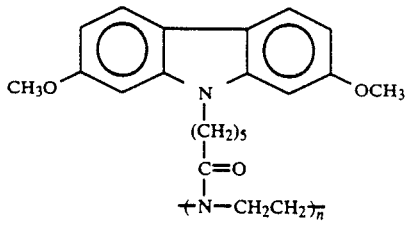

(D)

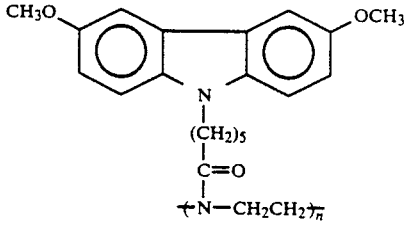

These hole transporting polymers may also be used blended with other film forming overcoat resins such as Makrolon, in the range of about 40% by weight to about 60% by weight, without the need for charge transport compound doping in the overcoat layer. For example, a 3.5 micrometers thick overcoating layer containing 60% by weight polyvinylcarbazole (structure A) and 40% by weight Makrolon provides an overcoating having adequate protection against charge transport compound leaching/crystallization and static-bend charge transport layer cracking after constant exposure to mineral oil.

The charge transport molecules used to dope the overcoating layer may be any of a number of known charge transport molecules which are employed in a charge transport layer such as those disclosed in U.S. Pat. No. 4,786,570. The charge transport molecules may be the same or different as that of the charge transport compound present in the charge transport layer. It is preferable to use the same charge transport molecules for overcoat doping as used in the charge transport layer. Charge transport molecules may include any of those mentioned above for the charge transport layer, and preferably include a compound represented as follows:

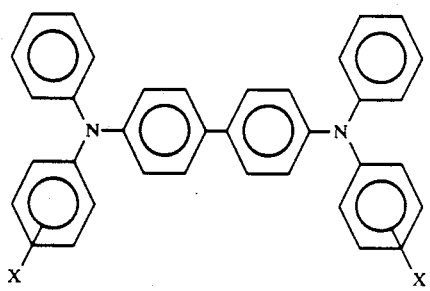

wherein X is selected from the group consisting of an alkyl group, having from 1 to about 4 carbon atoms and chlorine.

Preferably, the resin of the overcoating layer of the present invention is doped with about 3% by weight to about 10% by weight of a charge transport molecule, and more preferably, about 3% by weight to about 7% by weight. Doping with more than 10% of a charge transport molecule tends to lead to crystallization, leaching, and stress cracking. A doping of less than 3% by weight diminishes the charge transporting capability of the overcoating, and makes the photoreceptor functionally unacceptable.

The overcoating layer may be prepared by any suitable conventional technique and applied by any of a number of application methods. Typical application methods include, for example, hand coating, spray coating, web coating and the like. Drying of the deposited coating may be effected by any suitable conventional technique such as oven drying, infrared radiation drying, air drying and the like.

Overcoatings of about 3 micrometers to about 7 micrometers are effective in preventing charge transport molecule leaching, crystallization and charge transport layer cracking. Preferably, a layer having a thickness of about 3 micrometers to about 5 micrometers can be employed.

The invention will further be illustrated in the following, non-limitative examples, it being understood that these examples are intended to be illustrative only and that the invention is not intended to be limited to the materials, conditions, process parameters and the like recited herein.

COMPARATIVE EXAMPLE I

A photoconductive imaging member is prepared by providing a titanium coated polyester (Melinex available from ICI Americas Inc.) substrate having a thickness of 3 mils, and applying thereto, using a gravure applicator, a solution containing 50 grams 3-aminopropyltriethoxysilane, 15 grams acetic acid, 684.8 grams of 200 proof denatured alcohol and 200 grams heptane. This layer is then dried for 10 minutes at 135° C. in a forced air oven. The resulting blocking layer has a dry thickness of 0.05 micrometer.

An adhesive interface layer is then prepared by applying a wet coating over the hole blocking layer, using a gravure applicator, containing 0.5 percent by weight based on the total weight of the solution of copolyester adhesive (DuPont 49,000, available from E. I. du Pont de Nemours & Co.) in a 70:30 volume ratio mixture of tetrahydrofuran/cyclohexanone. The adhesive interface layer is then dried for 10 minutes at 135° C. in a forced air oven. The resulting adhesive interface layer has a dry thickness of 0.05 micrometer.

The adhesive interface layer is thereafter coated with a photogenerating layer containing 7.5 percent by volume trigonal selenium, 25 percent by volume N,N'-diphenyl-N,N'-bis(3-methylphenyl)-1,1'-biphenyl-4,4'-diamine, and 67.5 percent by volume polyvinylcarbazole. This photogenerating layer is prepared by introducing 80 grams polyvinylcarbazole to 1400 ml of a 1:1 volume ratio of a mixture of tetrahydrofuran and toluene. To this solution are added 80 grams of trigonal selenium and 10,000 grams of ⅛ inch diameter stainless steel shot. This mixture is then placed on a ball mill for 72 to 96 hours. Subsequently, 500 grams of the resulting slurry are added to a solution of 36 grams of polyvinylcarbazole and 20 grams of N,N'-diphenyl-N,N'-bis(3-methylphenyl)-1,1'-biphenyl-4,4'-diamine in 750 ml of 1:1 volume ratio of tetrahydrofuran/toluene. This slurry is thereafter applied to the adhesive interface with an extrusion die to form a layer having a wet thickness of about 0.5 mil. However, a strip about 3 mm wide along one edge of the substrate, blocking layer and adhesive layer is deliberately left uncoated by any of the photogenerating layer material to facilitate adequate electrical contact by the ground strip layer that is applied later. This photogenerating layer is dried at 135° C. for 5 minutes in a forced air oven to form a photogenerating layer having a dry thickness of 2.3 micrometers.

This coated member is simultaneously overcoated with a charge transport layer and a ground strip layer by coextrusion of the coating materials through adjacent extrusion dies similar to the dies described in U.S. Pat. No. 4,521,457. The charge transport layer is prepared by introducing into an amber glass bottle in a weight ratio of 1:1 N,N'-diphenyl-N,N'-bis(3-methylphenyl)-1,1'-biphenyl-4,4'-diamine and Makrolon 5705, a polycarbonate resin having a molecule weight of from about 50,000 to 100,000 commercially available from Farbenfabricken Bayer A.G. The resulting mixture is dissolved by adding methylene chloride. This solution is applied on the photogenerator layer by extrusion to form a coating which upon drying has a thickness of 24 micrometers.

The strip about 3 mm wide left uncoated by the photogenerator layer is coextruded as a ground strip layer along with the charge transport layer. The ground strip layer coating mixture is prepared by combining 525 grams of polycarbonate resin (Makrolon 5705, available from Bayer AG), and 7,317 grams of methylene chloride in a carboy container. The container is covered tightly and placed on a roll mill for about 24 hours until the polycarbonate is dissolved in the methylene chloride. The resulting solution is mixed for 15–30 minutes with about 2,072 grams of a graphite dispersion (12.3 percent by weight solids) of 9.41 parts by weight graphite, 2.87 parts by weight ethyl cellulose and 87.7 parts by weight solvent (Acheson Graphite dispersion RW22790, available from Acheson Colloids Company) with the aid of a high shear blade disperser (Tekmar Dispax Disperser) in a water cooled, jacketed container to prevent the dispersion from overheating and losing solvent. The resulting dispersion is then filtered and the viscosity is adjusted to between 325–375 centipoises with the aid of methylene chloride. This ground strip layer coating mixture is then applied to the photoconductive imaging member to form an electrically conductive ground strip layer having a dried thickness of about 15 micrometers.

During the transport layer and ground strip layer coextrusion coating process, the humidity is equal to or less than 15 percent. The resulting photoreceptor device containing all of the above layers is annealed at 135° C. in a forced air oven for 6 minutes.

An anti-curl coating is prepared by combining 882 grams of polycarbonate resin (Makrolon 5705, available from Bayer AG), 9 grams of copolyester resin (Vitel-PE 100, available from Goodyear Tire and Rubber Co.), and 9,007 grams of methylene chloride in a carboy container to form a coating solution containing 8.9 percent solids. The container is covered tightly and placed on a roll mill for about 24 hours until the polycarbonate and polyester are dissolved in the methylene chloride. The anti-curl coating solution is then applied to the rear surface (side opposite the photogenerator layer and charge transport layer) of the photoconductive imaging member by extrusion coating and dried at 135° C. for about 5 minutes to produce a dried film having a thickness of 13.5 micrometers.

EXAMPLE II

A 9 inches × 12 inches photoconductive imaging sample, without the ground strip layer, is cut from the imaging member of EXAMPLE I and using a 1.0 mil gap Bird applicator, an overcoating layer solution containing 5.0 grams Makrolon and 0.265 grams charge transport molecule N,N,-diphenyl-N,N'-bis(3-methylphenyl)-1,1'-biphenyl-4,4'-diamine dissolved in 94.735 grams of methylene chloride, representing 5.26 weight percent solid in the solution is applied thereto. The resulting imaging sample is allowed to stand for 5 minutes at 135° C. in a forced air oven. The dry overcoat thickness obtained is 1.9 micrometers and has 5 weight percent charge transport molecule doping.

EXAMPLE III

A photoconductive imaging sample is prepared following the same procedure and using the same overcoating solution as described in EXAMPLE II, except a 1.5 mil gap Bird applicator is employed to produce an overcoating of 3.1 micrometers dry thickness.

EXAMPLE IV

A photoconductive imaging sample is prepared in the same manner as described in EXAMPLE III except using a 8.9 weight percent solid coating solution to produce a 5.4 micrometers dry thickness overcoating layer.

EXAMPLE V

A photoconductive imaging sample is fabricated in the manner and using the coating solution as described in EXAMPLE IV except that a 2.0 mil gap Bird applicator is chosen to give a dry overcoating layer thickness of 7.3 micrometers.

EXAMPLE VI

A photoconductive imaging sample is fabricated in the same manner as described in EXAMPLE III with the exception that the coating solution contains 5.0 grams 4,4'cyclohexylidene diphenyl polycarbonate (available from Mitsubishi Chemicals) and 0.265 grams charge transport compound dissolved in 94.735 grams methylene chloride, representing 5.26 weight percent solid in the coating solution. The dry overcoating thickness is 3.2 micrometers and has 5 weight percent charge transport molecule doping.

EXAMPLE VII

A 9 inches × 12 inches imaging sample, without the ground strip layer, is cut from the imaging member of EXAMPLE I, and using a 1.5 mil gap Bird applicator, an overcoating solution containing 6.0 grams polyvinylcarbazole (having a molecular weight of 1,150,000 and available from BASF Corporation) dissolved in 94 grams methylene chloride is applied thereto. The wet overcoat is allowed to stand at room temperature for 5 minutes and dried at 135° C. for 5 minutes in a forced air oven. The resulting dry overcoating thickness is 3.1 micrometers and contains no charge transport molecule.

EXAMPLE VIII

A photoconductive imaging sample is fabricated in the same manner as described in EXAMPLE VII except that the overcoating solution contains 3.6 grams polyvinylcarbazole and 2.4 grams Makrolon dissolved in 94 grams methylene chloride. The resulting dry polymer blend overcoat is 3.5 micrometers thick and has no charge transport molecule doping.

EXAMPLE IX

A photoconductive imaging sample is fabricated in the same manner as described in EXAMPLE III except that the overcoating solution contains 4.735 grams Makrolon, 0.265 grams copolyester Vitel-PE 100 (from Goodyear Tire & Rubber Company), and 0.265 grams charge transport molecule dissolved in 94.735 grams methylene chloride, representing 5.26 weight percent solid in the solution. The dry polymer blend overcoat is 3.2 micrometers thick and consists of 90 weight percent Makrolon, 5 weight percent copolyester Vitel-PE 100, and 5 weight percent charge transport molecule doping.

EXAMPLE X

A photoconductive imaging sample is fabricated in the same manner as described in EXAMPLE III except that the copolyester Vitel-PE 100 is replaced by copolyester Vitel-PE 200 (available from Goodyear Tire &

Rubber Company). The dry polymer blend overcoat is 3.1 micrometers thick and consists of 90 weight percent Makrolon, 5 weight percent copolymer Vitel-PE 200, and 5 weight percent charge transport molecule doping.

EXAMPLE XI

The electrical properties of the photoconductive imaging samples prepared according to EXAMPLES I–X are evaluated with a xerographic testing scanner comprising a cylindrical aluminum drum having a diameter of 9.55 inches. The test samples are taped onto the drum. When set to rotation, the drum which carries the samples produces a constant surface speed of 30 inches per second. A direct current pin corotron, exposure light, erase light, and five electrometer probes are mounted around the periphery of the mounted photoreceptor samples. The sample charging time is 33 milliseconds. Both exposed and erase light are broad band white light (400–700 nm) outputs, each supplied by a 300 watt output Xerox arc lamp. The relative locations of the probes and lights are indicated in Table I below:

| ELEMENT | ANGLE (Degrees) | POSITION | DISTANCE FROM PHOTORECEPTOR |
|---|---|---|---|
| CHARGE | 0 | 0 | 18 mm (Pins)<br>12 mm (Shield) |
| Probe 1 | 22.50 | 47.9 mm | 3.17 mm |
| Expose | 56.25 | 118.8 | N.A. |
| Probe 2 | 78.75 | 166.8 | 3.17 mm |
| Probe 3 | 168.75 | 356.0 | 3.17 mm |
| Probe 4 | 236.25 | 489.0 | 3.17 mm |
| Erase | 258.75 | 548.0 | 125 mm |
| Probe 5 | 303.75 | 642.9 | 3.17 mm |

The test samples are first rested in the dark for at least 60 minutes to ensure achievement of equilibrium with the testing conditions at 40% relative humidity and 21° C. Each sample is then negatively charged in the dark to a development potential of about 900 volts. The charge acceptance of each sample and its residual potential after discharge by front erase exposure to 400 ergs/cm$^2$ of light exposure are recorded. The test procedure is repeated to determine the photo induced discharge characteristic of each sample by different light energies of up to 20 ergs/cm$^2$. The electrical testing results are collectively summarized in the following Table II.

TABLE II

| Type of Imaging Sample | Dark Decay Rate (v/sec.) | Residual Voltage (v) | $E_{\frac{1}{2}}$ (Erg/cm$^2$) |
|---|---|---|---|
| Example I, Control | 152 | 14 | 1.70 |
| Example II | 152 | 14 | 1.70 |
| Example III | 152 | 14 | 1.71 |
| Example IV | 151 | 15 | 1.72 |
| Example V | 149 | 30 | 1.92 |
| Example VI | 151 | 15 | 1.70 |
| Example VII | 151 | 15 | 1.71 |
| Example VIII | 151 | 15 | 1.73 |
| Example IX | 151 | 16 | 1.74 |
| Example X | 151 | 15 | 1.72 |

The data shows that the imaging samples having overcoating thicknesses of 5.4 micrometers or less give electrical results equivalent to those obtained for the control test sample of Example I. They exhibit 60 v to 70 v cycle-down after 50,000 cycles of repeated charging/discharging cyclic testing. The 50,000 cycle testing results in little or no change in the residual potentials of these samples. However, the imaging sample of EXAMPLE V having a 7.3 micrometers overcoat is seen to develop 100 v cycle-up after 50,000 cycles of electrical testing with substantial residual potential climbing from 30 v at the beginning of the test to 65 v at the end of the test. As reflected by its higher $E_{\frac{1}{2}}$ value of 1.92 vs 1.70 of the control test sample, the 7.3 micrometers overcoated imaging sample has also produced notably softer photo induced discharge characteristics.

The solvent resistance study for all the above imaging samples is carried out by cutting them into 2 inches×4 inches test samples. These test samples first are statically bent over 19 mm diameter rollers with their charge transport layers facing upward. The static-bend samples are then tested for solvent interaction by exposure to mineral oil. The reason that mineral oil is chosen for a solvent interaction test is because it is the solvent carrier used in liquid ink systems. Neither charge transport molecule leaching/crystallization nor charge transport layer cracking at the bent area are observed after 17 days of constant mineral oil contact, with the exception of the test sample of Example II (which has a 1.9 micrometers overcoat) and the control test sample of Example I (which has no overcoat protection). For the control sample of Example I, the charge transport compound leaching/crystallization and charge transport layer cracking are visible, under 100 times magnification using an optical microscope, after 45 minutes of mineral oil contact, while leaching/crystallization and cracking are noted only after about 2 days of testing for the 1.9 micrometers overcoated sample of EXAMPLE II.

The overall results obtained from the electrical and solvent exposure tests indicate that a photoconductive imaging member having a 3.0 micrometers to 5.4 micrometers film forming polymer or polymer blend overcoat of the present invention can totally eliminate the problems of charge transport compound leaching/crystallization and bending stress induced charge transport layer cracking after prolong mineral oil exposure. An overcoating in this thickness range produces no negative electrical affects. The overcoat layers of the present invention are found to fuse to the charge transport layer of the imaging members thereby providing excellent adhesion strength. No delamination occurs.

EXAMPLE XII

A 10.3 inches×16.2 inches photoconductive imaging sample having a ground strip layer is cut from the imaging member of Example I and overcoated with a 3.2 micrometers dry thickness layer of Makrolon having 5 weight percent charge transport molecule doping. The application of the overcoat is achieved by spraying a 3 weight percent solution, containing Makrolon/charge transport molecule dissolved in a 60:40 ratio of methylene chloride:1,1,2 trichloroethane solvent mixture, over the imaging sample. The overcoated wet film is dried for 5 minutes at 135° C., and the resulting imaging sample is then ultrasonically welded into a photoreceptor belt. The fabricated photoreceptor belt is tested in a Xerographic machine using a liquid ink system, and gives good electrical performance and print quality. No charge transport compound leaching/crystallization/-charge transport layer cracking are evident after 300 cycles of xerographic imaging function.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member, comprising a conductive layer and, in sequence, a charge generating layer, a charge transport layer and an overcoating layer thereon comprising a film forming polymer binder and a hole transport compound in an amount which prevents crystallization and leaching of charge transport material in said charge transport layer upon exposure to liquid xerographic inks and ink solvent carriers.

2. The electrophotographic imaging member of claim 1, wherein said hole transport compound in said overcoating layer is present in an amount less than about 10% by weight based on weight of said overcoating layer.

3. An electrophotographic imaging member comprising in sequence a charge generating layer, a charge transport layer and an overcoating layer thereon comprising a film forming binder and between about 3% to about 7% by weight of a hole transport compound based on weight of said overcoating layer.

4. The member of claim 3, wherein said charge transport layer contains at least 35% by weight of said hole transport compound based on weight of said charge transport layer.

5. The member of claim 3, wherein aid binder is at least one binder selected from the group consisting of polycarbonates, polycarbazoles, polyacrylates, polyarylates, polycarbonate copolymers, and polystyrenes.

6. The member of claim 3, wherein said hole transport compound is one or more compounds having the general formula;

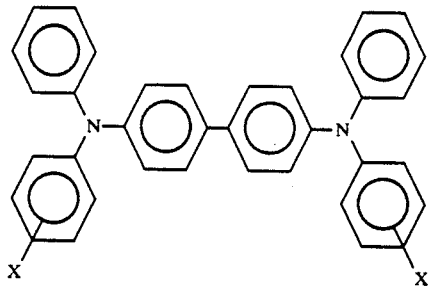

wherein X is selected from the group consisting of an alkyl group having from 1 to about 4 carbon atoms and chlorine.

7. The member of claim 3, wherein said overcoating layer has a thickness of about 3 micrometers to about 10 micrometers.

8. The member of claim 3, wherein said overcoating layer has a thickness of about 3 micrometers to about 6 micrometers.

9. An elecrophotographic imaging member, comprising:

an electrically conductive supporting substrate;

a charge generating layer;

a charge transport layer adjacent said charge generating layer, said charge transport layer comprising a charge transport compound; and an overcoating layer adjacent said charge transport layer, said overcoating layer comprising a film forming polymer binder and a hole transport compound in an amount which prevents crystallization of said charge transport compound in a said charge transport layer upon exposure to liquid zerographic inks and ink solvent carriers.

10. The electrophotographic imaging member of claim 9, wherein aid overcoating layer comprises about 3% to about 7% by weight of said hole transport compound based on weight of said overcoating layer.

11. The electrophotographic imaging member of claim 10, wherein said charge transport layer comprises more than about 35% by weight of said charge transport compound based on weight of said charge transport layer.

12. The electrophotographic imaging member of claim 9, wherein said hole transport compound is represented by the molecular formula:

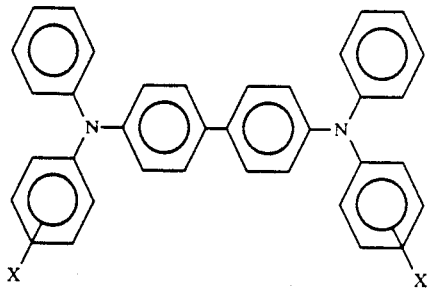

wherein X is selected from the group consisting of an alkyl group having from 1 to about 4 carbon atoms and chlorine.

13. The electrophotographic imaging member of claim 9, wherein said first and second charge transport compounds are the same.

14. The electrophotographic imaging member of claim 9, wherein aid film forming polymer binder is a carbazole selected from the group consisting of:

(A)

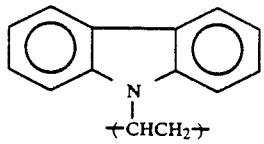

(B)

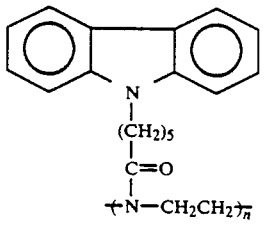

(C)

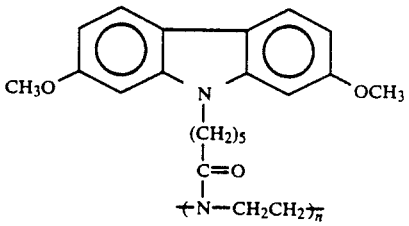

-continued (D)

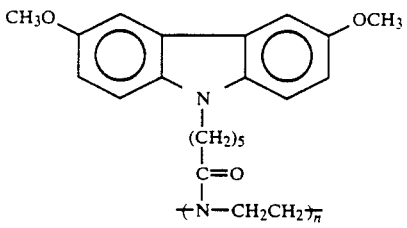

15. An electrophotographic imaging member, comprising a conductive layer and, a sequence, charge generating layer, a charge transport layer and an overcoating layer thereon, said overcoating layer comprising a hole transporting carbazole polymer selected from the group consisting of:

(A)

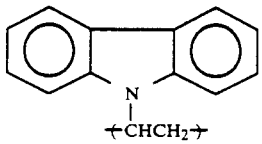

-continued (B)

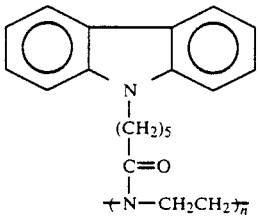

(C)

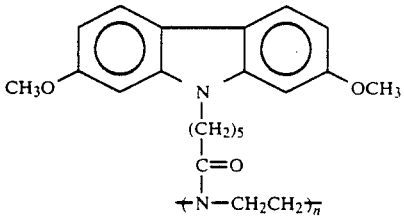

(D)

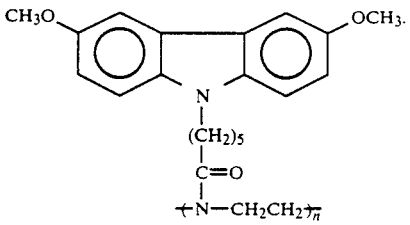

16. The electrophotographic imaging member of claim 15, further comprising a film forming binder.

17. The electrophotographic imaging member of claim 16, wherein said overcoating layer comprises at least 30 weight percent of said carbazole polymer based on weight of said overcoating layer.

* * * * *